United States Patent [19]

Weber

[11] Patent Number: 5,016,400

[45] Date of Patent: May 21, 1991

[54] PRESSURE BAR FOR A BELT GRINDING MACHINE

[76] Inventor: Georg Weber, Friesener Strabe 27,, D-8640 Kronach, Fed. Rep. of Germany

[21] Appl. No.: 500,787

[22] Filed: Mar. 28, 1990

[30] Foreign Application Priority Data

Mar. 31, 1989 [DE] Fed. Rep. of Germany ..... 8903949

[51] Int. Cl.[5] ..... B24B 21/00

[52] U.S. Cl. ..... 51/141; 51/135 R

[58] Field of Search ..... 51/135 R, 137, 140, 51/141

[56] References Cited

U.S. PATENT DOCUMENTS

| | | | |
|---|---|---|---|
| 3,167,889 | 2/1965 | Jacobi | 51/141 |
| 3,694,966 | 10/1972 | Heesemann | 51/141 |
| 3,859,757 | 1/1975 | Heesemann | 51/141 |
| 4,527,359 | 7/1985 | Stump et al. | 51/141 |

*Primary Examiner*—Frederick R. Schmidt

*Assistant Examiner*—M. Rachuba

[57] ABSTRACT

A pressure for a belt grinding machine includes an elongated carrier with a base plate facing the grinding belt and having a plurality of bores arranged in a matrix, a plurality bolt shaped pressure members supported in the bores for free axial movement and which are adapted to engage the grinding belt with their free ends and which with their other ends are urged toward the grinding belt by a hose inflatable by a pressure fluid. The hose is surrounded by a plurality of frame shaped pressure shoes arranged next to one another in the longitudinal direction of the carrier, each of which pressure shoes is adjustable vertically relative to the base plate by a positioning device. The pressure shoes each have a frame side facing the base plate provided with bores registering with the base plate bores for receiving the pressure members, and inside of each pressure shoe and between the hose and the adjacent ends of the pressure members is a flexible pressure distribution element having a higher stiffness than that of the hose material.

11 Claims, 3 Drawing Sheets

PRESSURE BAR FOR A BELT GRINDING MACHINE

BACKGROUND OF THE INVENTION

The invention concerns a pressure bar for a belt grinding machine including a longitudinally extending carrier with a base plate facing the grinding belt having a plurality of bores arranged in a matrix, in which bores bolt-shaped pressure members are held for free axial movement, which bolts are intended to engage the grinding belt with their free ends and are urged in the direction toward the grinding belt by a hose inflatable with a pressure fluid and located on the side of the base plate facing away from the grinding belt.

In the deburring and descaling of large sheet metal parts by means of a belt grinding machine different problems arise. The sheet metal parts to be worked in general are not even. The larger the parts the larger in general are the tolerances to be evened out by the grinding belt or pressure bar in order to reach a uniformly flat finish or to grind off from the sheet the burrs whose removal is desired. Work pieces of large measurement also require large grinding performances. Moreover because of their large dimensions the parts are so heavy that their handling is extremely difficult. When contoured pieces are cut out of the sheets by automatic cutting, plasma cutting or similar methods melted metal runs downwardly and forms a burr on the underside of the sheet which is ground off. In order not to have to turn the parts coming out of the cutting apparatus, it has already been proposed in German Utility Model G 87 07 974 to grind the sheet metal part from below. This answers the difficulty in the handling of large work pieces.

In wide belt grinding machines which are also employed in the solution described in German Utility Model G 87 07 974 the grinding belt length between the two guide rolls is relatively short. A small displacement of the grinding belt on the short stretch between the guide rolls creates therefore a large reaction force so that a smoothing out of tolerances is possible only in relatively small areas. A considerable improvement has already been achieved here by a pressure bar as described in European Patent Application 0,210,654.

Wide belt grinding machines also have the disadvantage arising from their construction, that the spacing between the guide rolls cannot be diminished below a certain amount because of the pressure bar lying between them. This again means that the minimum length measured in the work piece feed direction and the minimum thickness of the work pieces to be worked in a wide belt grinding machine must be larger than for work pieces worked in a transverse belt grinding machine in order that the work pieces can pass problem free through the wide belt grinding machine, since in the grinding zone they can only be held on one side.

This difficulty can be solved with a grinding belt which moves in a direction perpendicular to the feed direction of the work pieces and which in the feed direction of the work pieces has only a small width. Transverse belt grinding machines for grinding wood have been known for a long time, in the case of which numerous solutions for controllable pressure bars have been proposed wherein the grinding belt is pressed against a work piece in accordance with the shape of the work piece. In the attempt to substitute one such transverse belt grinding machine for the grinding of metallic work pieces it has been shown that neither the grinding belts nor the sliding coating arranged between the pressure bar and the grinding belt stand up to the demands of the grinding process. The belts and the sliding coating after a short time are permanently thermally damaged.

The invention has as its object the provision of a pressure bar of the previously mentioned type which makes possible the grinding, especially for deburring and descaling, of large metallic work pieces with a transverse belt grinding machine.

This object is solved in accordance with the invention in that the previously mentioned hose of the pressure bar is surrounded by a plurality of frame-shaped pressure shoes which in the longitudinal direction of the carrier are arranged next to one another and are each adjustable perpendicularly to the base plate by a positioning apparatus, in that each shoe has bores in the side of the shoe facing the base plate registering with the bores of the base plate for receiving the pressure members, and in that inside of each pressure shoe between the hose and the adjacent ends of the pressure members is a flexible pressure distributing element having a higher stiffness than the material of the hose.

With the presently described pressure bar trouble free grinding results can be achieved with a transverse belt grinding machine with little wear of the grinding belt. With the pressure bar of the invention it is possible to bring the pressure members and therewith the grinding belt into engagement with the work piece only in certain areas determined by the shape of the work piece and of the problem areas. Therefore, the engagement length of the grinding belt with the work piece is reduced to a minimum as a result of which the heating of the grinding belt is substantially reduced. The comparatively soft hose passing through the shoes permits relative movement between the individual shoes. The stiff pressure equalizing element in each pressure shoe serves to provide a flat pressing of the individual pressure members inside a pressure shoe, but permits at the same time a relative movement between the individual pressure members inside of the same shoe so that not only can large tolerances be evened out, but also burrs and flat areas of the work piece can be ground which are smaller than the pressure face of one work shoe.

Preferably the pressure distribution element is formed by a sleeve inside each pressure shoe surrounding a section of the hose. In this way the pressure distribution element can be formed from a section of another hose. One such sleeve is simple to make and assures a good seating on the first hose.

Preferably the pressure shoes and their associated positioning devices, which for example can be pneumatic or hydraulically actuated work cylinders, are so moveably connected that the pressure shoes are each universally pivotal and rotatable to the degree permitted by the play of the pressure members in their bores. Therefore, no particular guides are necessary for the pressure shoes.

Preferably the bolt-shaped pressure members are secured against falling out of the bores of the base plate and to the pressure shoes by stops on their end portions. In connection with this each bolt-shaped pressure member preferably has a head on its side facing the grinding belt, which has the additional advantage that the specific loading of the grinding belt is reduced. At the other end it is sufficient if the bolt is secured by a snap ring or the like. To facilitate the moveability of the pressure shoes relative to one another, in accordance with the invention the pressure shoes are so formed that the remote horizontal frame side of each pressure shoe, which is spaced from the base plate and connected to the positioning device, in going from each vertical side surface of the frame to the middle of the shoe decreases in size.

To avoid areas in which no pressure is applied to the work piece and in which therefore no grinding takes place, which areas exist in a matrix type arrangement of the pressure members, the bores of the base plate and of the horizontal frame side of the pressure shoe facing the base plate are displaced relative to one another in the direction of the hole columns and if necessary also in the direction of the hole rows. The displacement is so chosen that the pressure members of one column or row are displaced only a fraction of the bolt diameter with respect to the pressure members of the neighboring column or row, and for a given bolt diameter and bolt spacings the amount of the displacement and the number of the pressure member columns or rows are so chosen that in each plane parallel to the feed direction of the work pieces and perpendicular to the grinding plane the grinding length is at least nearly the same.

The invention further concerns a belt grinding machine for grinding flat work pieces in a pass-through method, including a work piece support and at least one grinding assembly with an endless grinding belt circulating transversely to the feed direction of the work pieces, and a pressure bar for pressing the belt to the upper surface of the work pieces which bar is made in the above-described way. The grinding assembly can be arranged above the work piece support. For reasons of easier handling of the work pieces the grinding assembly is, however, preferably arranged below the work piece support. In both cases it is generally sufficient that the pressure members be actively adjustable only in the direction toward the work pieces, since the pressure members in other respects are rearwardly displaced from their initial positions spaced from the work piece by the belt tension (grinding assembly above the work piece support) or by the force of gravity (grinding assembly below the work piece support).

To reduce the thermal loading of the grinding belt, at least two or perhaps more grinding assemblies can be arranged behind one another in the feed direction of the work pieces through the belt grinding machine, with the length and position of the pressure bar of the grinding assembly being so chosen that the resulting grinding zones collectively cover at least the entire width of the transport path. This reduces for each individual grinding belt the relationship of the engagement area to the belt length and therefore also reduces the thermal loading. Alternatively, several grinding assemblies can be arranged behind one another whose grinding zones each extend over the full width of the transport path; the cutting performance of each assembly however being reduced to reduce the thermal loading.

Further features and advantages of the invention are apparent from the following description, which in conjunction with the accompanying drawings explain the invention in connection with exemplary embodiments thereof.

DETAILED DESCRIPTION OF THE PREFERRED EMBODIMENTS

Figure 1:
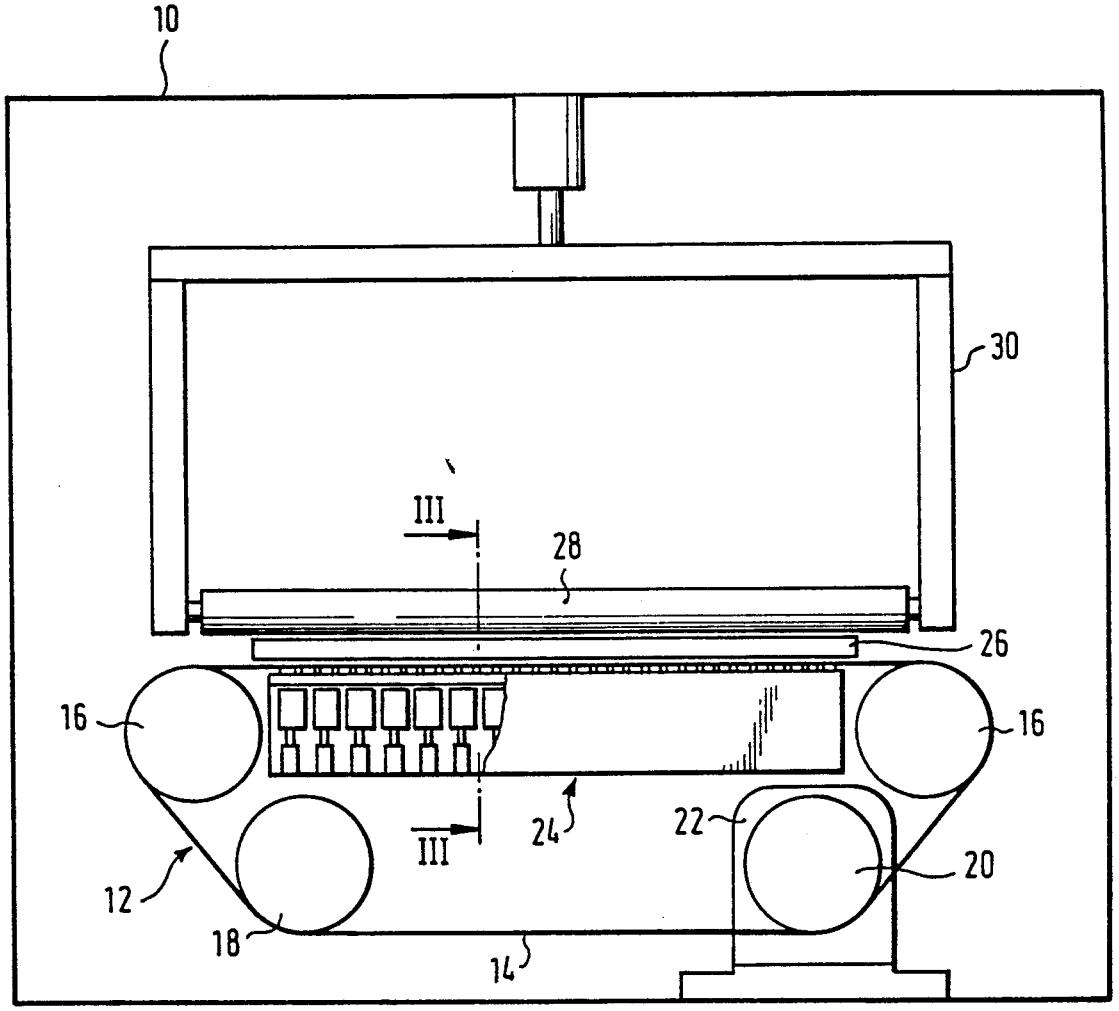
FIG. 1 is a schematic side view of a grinding assembly of a transverse belt grinding machine arranged below the work piece support.

In FIG. 1 the frame of a transverse belt grinding machine is indicated at 10. The representation of FIG. 1 is so chosen that the direction of the work pieces in passing through the machine move in the direction of viewing toward the illustration plane. In the lower part of the frame is a grinding assembly indicated generally at 12 with a circulating grinding belt 14 moving perpendicular to the work piece feed direction, which belt is guided over guide rolls 16 and 18 as well as over a drive wheel 20 of a drive motor 22. Between the upper rolls 16 is a pressure bar indicated generally at 24, which is explained in more detail hereinafter. Before and behind the grinding assembly 12 in the feed direction are non-illustrated rolls arranged transversely to the feed direction, which serve to support and to transport a work piece 26 through the machine. The work piece 26 is pressed against the work piece support by rolls 28 arranged perpendicularly to the direction and supported by a frame 30. The frame 30 is in a non-illustrated way adjustable in height relative to the frame 10 so that it can be suited to the thickness of the instant work piece.

Figure 2:
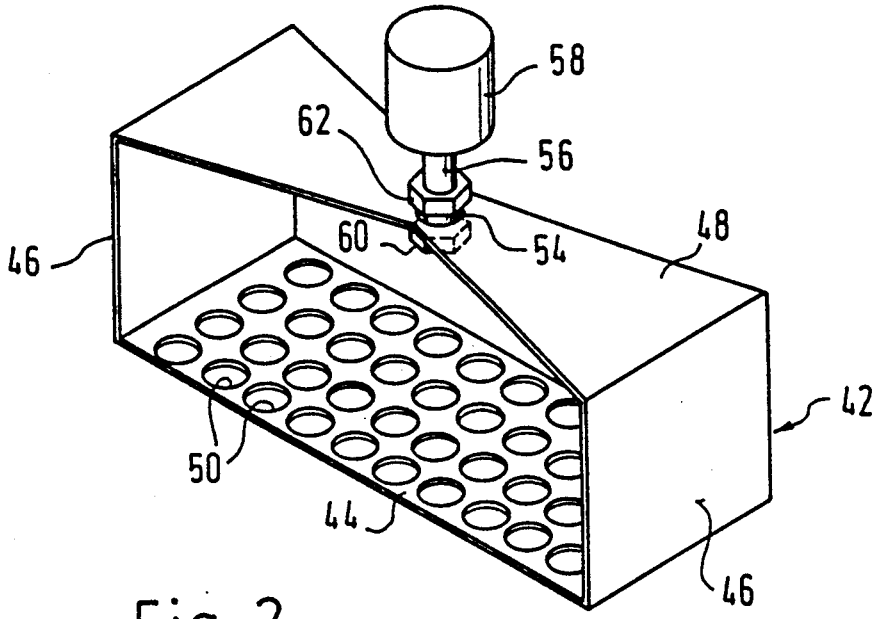
FIG. 2 is a perspective schematic view of one of the individual pressure shoes of the grinding assembly of FIG. 1.
Figure 3:
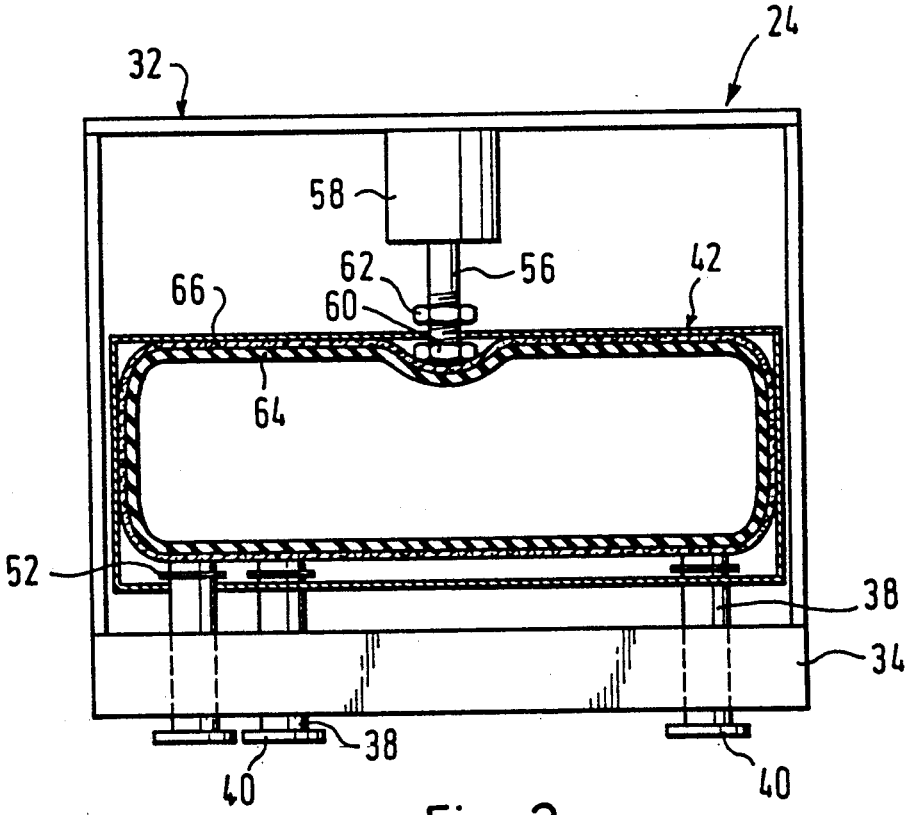
FIG. 3 is a sectional view taken on a plane passing through the pressure bar and taken on the line III—III of FIG. 1.

The pressure bar 24 includes a box shaped carrier 32 with a base plate 34 facing the grinding belt 14. The base plate 34 has a plurality of bores 36 arranged in rows and columns (FIG. 4) which will be discussed in more detail here and after. These bores 36 serve for receiving bolts 38 which serve as pressure members and which are intended to engage the inner side of the grinding belt 14 with their heads 40 which are enlarged in comparison to the bolt shaft. Inside the elongated box shaped carrier 32 are several pressure shoes 42 arranged next to one another in the longitudinal direction of the carrier 32. One such pressure shoe is illustrated in detail in FIG. 2. It includes a frame with a horizontal frame side 44 facing the base plate 34, two vertical frame sides 46 and another horizontal frame side 48 remote from the base plate 34. Bores 50 are provided in the frame side 44, which bores correspond in diameter to the bores 36 in the base plate 34 and whose arrangement corresponds to a portion of the arrangement of the holes in the base plate 34, so that the bores 36 and 50 in the area of the base plate 34 overlapped by the pressure shoe register with one another. Therefore the bolts 38 can with their ends remote from their heads pass through the bores 50. To prevent the bolts from falling from the bores 50 each is secured with a snap ring 52 (FIG. 3). The horizontal frame side 48 which is remote from the base plate 34 diminishes in going from the two frame vertical sides 46 to the middle. In the small middle area of the frame side 48 a opening 54 is provided through which the piston rod 56 of a positioning device, in the form of a pressure fluid activated work cylinder 58, passes with radial play. The pressure shoe 42 is secured :o the piston rod 56 by nuts 60,62 screwed onto the piston rod so that it is universally free to rotate or pivot relative to the piston rod to the degree permitted by the bolts 38. Thereby, without an expensive guiding of the pressure shoes it is assured that the bolts 38 with radial play can be moved without constraint.

The pressure shoes 42 which lie next to one another form an open channel through which a flexible hose 64 common to all pressure shbes extends and which is filled with pressurized air. In the area of each pressure shoe 42 the hose is surrounded by a flexible sleeve 66 which is made of a material clearly stiffer than that of the hose 64. The ends of the bolts which are remote from the bolt heads engage this sleeve 66.

In the above described arrangement the relatively flexible hose 64 assures a moveability of the pressure shoes 42 perpendicularly to the grinding plane. In this way the pressure shoes 42 can be individually adjusted in the direction toward the work piece 26 in order to press the grinding belt toward the area of the work piece 26 which is to be ground. In connection with this the pressure shoes are constantly pressed toward the base plate 38 with their frame sides 44.

The sleeves 66 which are, in comparison to the hose 64, harder and more durable assure that all of the bolts are similarly driven out of the pressure shoe 42. The sleeve 66 is however flexible enough to accommodate an individual withdrawn bolt so that the bolts can collectively follow desired unevennesses and contours in the work piece upper surface, as is already described in European Patent Application 0,210,654.

The pressure shoes 42 can be made very small so that a fine division of the pressure bar 32 is possible. The grinding belt 14 needs to be pressed against the work piece only in the area in which actual grinding is to take place. Therefore it is possible not only to compensate for large tolerances in the work pieces, but the contact length between the grinding belt 14 and the work piece 26 in the area to be ground is reduced so that the heating of the grinding belt and wear can be considerably reduced while at the same time obtaining good grinding performance.

Figure 4:
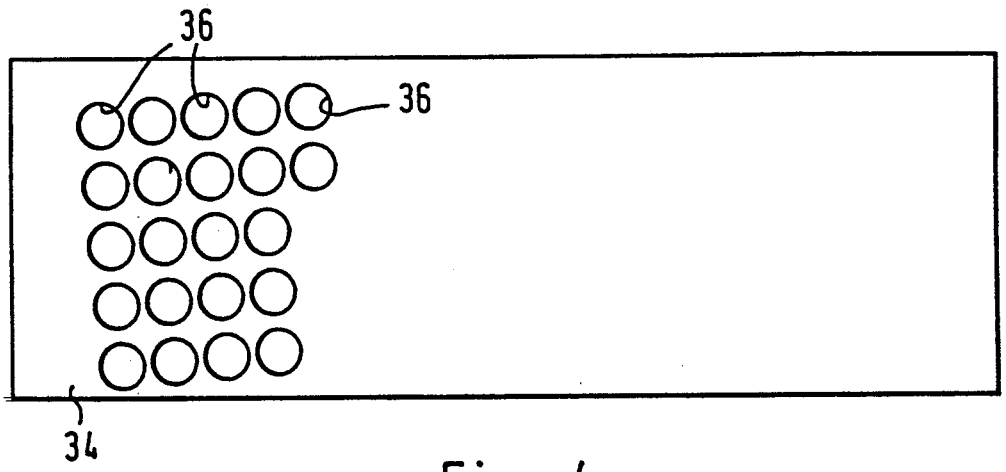
FIG. 4 is a plan view of the base plate of the pressure bar of the grinding assembly of FIG. 1.

FIG. 4 shows schematically the arrangement of the bores 36 in the base plate 34. As described in European Application 0,210,654 the bores are displaced relative to one another in adjacent rows in the length direction of the rows only by a fraction of the diameter of the bores or bolts. For a given bore diameter and a given spacing of the bores of each row the displacement of two bores following one another in the feed direction and the number of bore rows is so determined that, with respect to going along the width of the pressure bar, that at each location at least nearly the same engagement time of the bolts 38 with the work piece 26 is achieved. While in the solution according to European Patent Application 0,210,654 the bores are arranged in rows running parallel to the pressure bar edges, the pattern of the bores in the pressure bar 24 according to FIG. 4. of the present application also optimizes the equalizing of the engagement time in the direction of the rows. That means, that the hole columns lying next to one another likewise are displaced relative to one another by a fraction of the bore diameter, so that also with respect to the row direction an omission free covering of the surface of the base plate 34 results.

Figure 5:
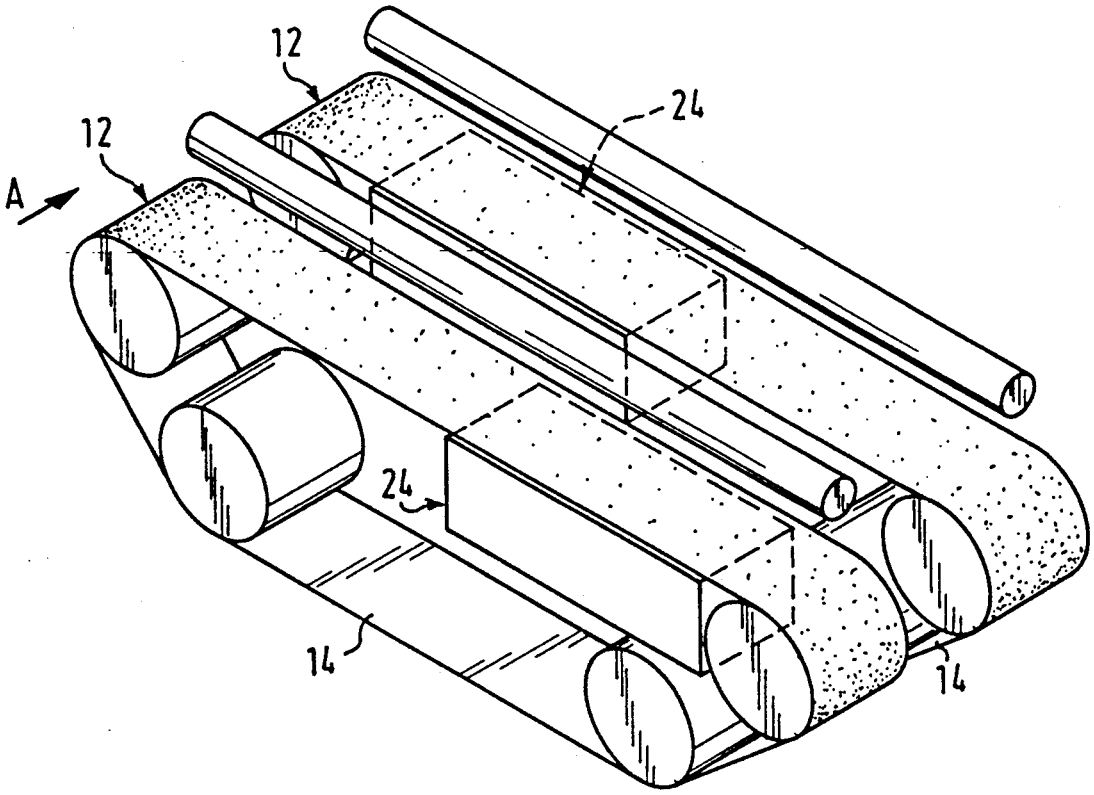
FIG. 5 is a schematic view of two grinding assemblies comprising a second embodiment of the invention.

FIG. 5 shows schematically a machine with two grinding assemblies 12 arranged behind one another in the feed direction A of the work pieces. The pressure bars 24 of both grinding assemblies each extend only over somewhat more than half the width of the transport path so that they collectively cover the entire width of the path. This reduces in half for each individual grinding belt 14 the ratio of the engagement zone to the grinding belt length so that the cooling of the belts is improved and the thermal loading can be reduced. Also several grinding assemblies can be arranged behind one another with smaller grinding zones in the event the thermal loading for each individual grinding belt is to be further reduced.

I claim:

1. A pressure bar for the grinding belt of a belt grinding machine, said pressure bar including an elongated carrier with a base plate facing the grinding belt and having a plurality of bores arranged in a matrix, a plurality of pressure members supported in said bores in said base plate for free axial movement relative to said base plate, said pressure members being adapted to engage the grinding belt with their free ends and being urged toward said grinding belt by a hose located on the opposite side of said base plate from said grinding belt inflatable by a pressure fluid, said hose being surrounded by a plurality of frame shaped pressure shoes arranged next to one another in the longitudinal direction of the carrier and each of which shoes is adjustable perpendicularly to said base plate by a positioning device, said pressure shoes each having a frame side facing said base plate with bores registering with said bores of said base plate for receiving said pressure members, and a flexible pressure distributing element arranged inside each of said pressure shoes between said hose and adjacent ends of said pressure members, said pressure distribution element having a higher stiffness than the material of said hose.

2. A pressure bar according to claim 1 further characterized in the pressure distribution element associated with each of said pressure shoes being a sleeve surrounding that portion of said hose which is received in said pressure shoe.

3. A pressure bar according to claim 1 further characterized in that each of said pressure shoes is so moveably connected with its associated adjusting device that the pressure shoe is universally pivotal and rotatable relative to the adjusting device to the degree permitted by the play of the pressure members in the bores.

4. A pressure bar according to claim 1 further characterized in that the bolt shaped pressure members have stops on their end regions to prevent said pressure members from falling out of said bores of said base plate and of said pressure shoes.

5. A pressure bar according to claim 1 further characterized in that each of said pressure shoes has a horizontal frame side remote from said base plate which is connected to the associated positioning device which remote frame side decreases in size in going from each of the vertical sides of the shoe to the middle of the shoe.

6. A pressure bar according to claim 1 further characterized in that the bores in the base plate and in the frame side of the pressure shoe are displaced relative to one another in the column direction.

7. A pressure bar according to claim 1 further characterized in that the bores in the base plate and in the adjacent frame side of the pressure shoes are displaced relative to one another in the row direction.

8. A belt grinding machine for grinding flat work pieces in a pass through process, said belt grinding machine including a work piece support and at least one grinding assembly with an endless grinding belt circulating in the direction transversely to the feed direction of the work pieces, and a pressure bar for pressing the grinding belt onto the upper surface of the work pieces, said pressure bar including an elongated carrier with a base plate facing the grinding belt and having a plurality of bores arranged in a matrix, a plurality of pressure members supported in said bores in said base plate for free axial movement relative to said base plate, said pressure members being adapted to engage the grinding belt with their free ends and being urged toward said grinding belt by a hose located on the opposite side of said base plate from said grinding belt inflatable by a pressure fluid, said hose being surrounded by a plurality of frame shaped pressure shoes arranged next to one another in the longitudinal direction of the carrier and each of which shoes is adjustable perpendicularly to said base plate by a positioning device, said pressure shoes each having a frame side facing said base plate with bores registering with said bores of said base plate for receiving said pressure members, and a flexible pressure distributing element arranged inside each of said pressure shoes between said hose and adjacent ends of said pressure members, said pressure distribution element having a higher stiffness than the material of said hose.

9. A belt grinding machine according claim 8 further characterized in that the grinding assembly is arranged above the work piece support.

10. A belt grinding machine according to claim 8 further characterized in that the grinding assembly is arranged below the work piece support.

11. A belt grinding machine according to claim 10 further characterized in that at least two belt grinding assemblies are arranged behind one another in the feed direction of the work pieces, the position and the length of the pressure bars of the grinding assemblies being so chosen that the resulting grinding zones collectively cover at least the width of the transport path of the work pieces.

* * * * *